US006145228A

United States Patent [19]

LaChance

[11] Patent Number: 6,145,228

[45] Date of Patent: Nov. 14, 2000

[54] APPARATUS FOR SIMULATING FALLING SNOWFLAKES

[76] Inventor: James L. LaChance, 21701 Sherwood, Belleville, Mich. 48111

[21] Appl. No.: 09/188,517

[22] Filed: Nov. 9, 1998

[51] Int. Cl.[7] ..... G09F 13/00

[52] U.S. Cl. ..... 40/431; 40/409; 40/410; 40/442; 362/441; 362/809

[58] Field of Search ..... 40/409, 410, 427, 40/429, 430, 431, 433, 435, 442; 362/124, 806, 808, 809, 441

[56] References Cited

U.S. PATENT DOCUMENTS

| | | | |
|---|---|---|---|
| 1,747,556 | 2/1930 | Price . | |
| 2,170,368 | 8/1939 | Gentilini | 40/433 |
| 2,699,621 | 1/1955 | Levinson | 40/427 |
| 3,431,409 | 3/1969 | Richter, III et al. | 362/252 |
| 4,171,882 | 10/1979 | Johnson, III et al. | 40/433 X |
| 4,214,296 | 7/1980 | Magett | 362/32 |
| 4,250,537 | 2/1981 | Roegner et al. | 362/86 |
| 4,307,528 | 12/1981 | Dewees et al. | 40/427 X |
| 4,764,850 | 8/1988 | Albanese | 362/35 |
| 4,972,305 | 11/1990 | Blackburn | 362/234 |
| 5,272,604 | 12/1993 | Lin | 362/96 |
| 5,613,799 | 3/1997 | Guide | 40/431 X |

*Primary Examiner*—Terry Lee Melius
*Assistant Examiner*—Andrea Chop
*Attorney, Agent, or Firm*—Charles W. Chandler

[57] ABSTRACT

A decorative hollow Christmas ornament supports a generally spherical body having a plurality of flat, small reflective surfaces for rotation about a horizontal axis. A light source disposed a distance from the reflective spherical transmits light to the small flat surfaces so that their images are then reflected to a wall, such as the exterior of a house, to simulate descending snowflakes.

12 Claims, 2 Drawing Sheets

APPARATUS FOR SIMULATING FALLING SNOWFLAKES

BACKGROUND OF THE INVENTION

This invention is related to apparatus for simulating descending snowflakes by projecting a light source onto a rotating spherical body having small planar reflective surfaces, such that light rays are reflected from several surfaces on to a remote surface.

Light reflective bodies, frequently in the form of a sphere or other shapes, and supporting a plurality of small reflecting or mirror surfaces in order to project light image patterns on a wall, are known.

U.S. Pat. Nos. 1,747,556 issued to William E. Price, Feb. 18, 1930 for "Decorative Lighting"; and 4,250,537 issued Feb. 10, 1981 to George P. Roegner et al. for "Discotheque Simulating Home Entertainment System" are representative of such art.

Usually the reflective body is rotated around a vertical axis in the path of one or more light sources to produce light rays which are projected onto a remote surface as either decorative lighting or part of an entertainment center. Usually the light sources are disposed a fixed distance with respect to the reflective body.

I am unaware of any prior art that suggests using a rotating reflective surface for simulating snowflakes descending an exterior wall, such as the wall of the house.

SUMMARY OF THE INVENTION

The broad purpose of the present invention is to provide a light reflecting apparatus for simulating falling snowflakes on a remote wall, such as the exterior wall of a residence.

The preferred embodiment of the invention comprises a body supporting a plurality of flat, small mirror surfaces, each being mounted in a plane at an angle from the planes of the other reflective surfaces. The body is mounted in a hollow housing, which preferably has the configuration of a Santa Claus or another Christmas-oriented shape. The body surface is rotated about a horizontal axis while being protected from the elements by the housing. The housing has an opening so that a light source can transmit light rays onto the mirror surfaces which in turn, are reflected onto a remote wall.

The light source preferably comprises a electrically-energized light mounted on a stake so as to be implanted in the ground at an adjusted distance from the rotating body. A mask is mounted on the light source having a small hole with a diameter accommodating the desired diameter of the descending simulated snowflakes. Flat reflective surfaces are preferred so as not to unduly enlarge the light rays that are transmitted through the mask to the rotating body.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
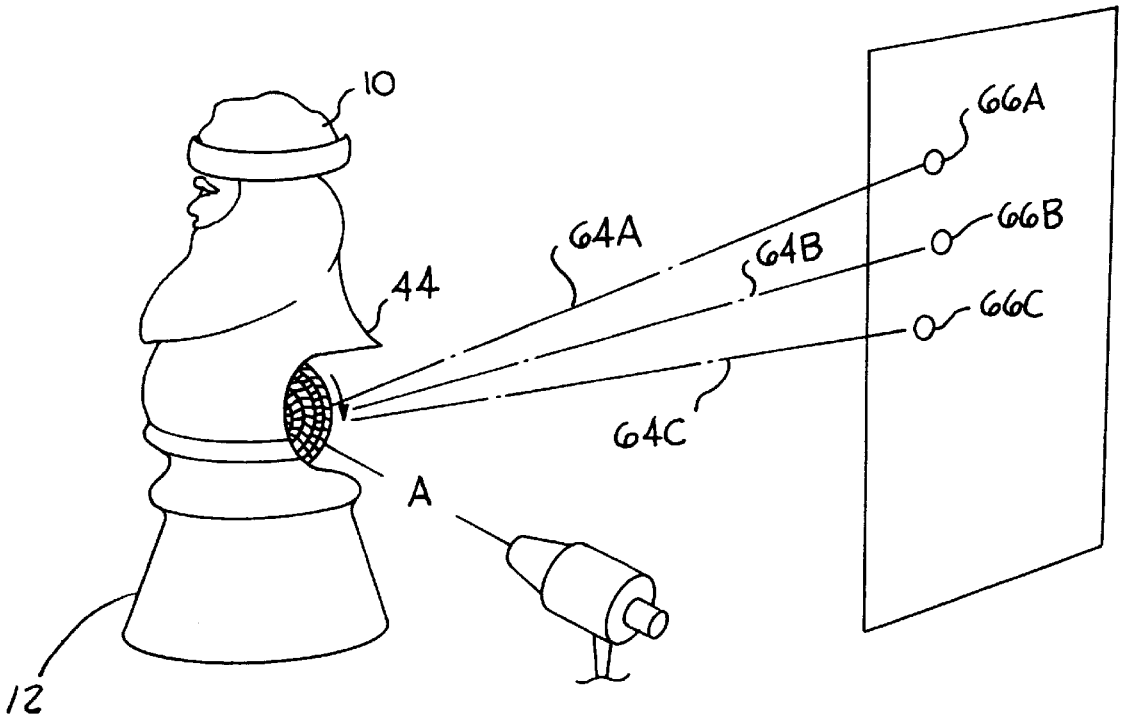
FIG. 1 is a perspective view showing a light source transmitting light rays to a rotating reflective body which in turn are reflected toward a remote wall.

Referring to the drawings, FIG. 1 illustrates a hollow plastic housing 10, preferably about 3 feet tall and having a Christmas-type configuration, such as a Santa Claus. Housing 10 has a base 12 shaped in the form of a container which is filled with sand 14 in order to stabilize the housing on ground 16 in an upright position. In warm climates, the sand may be replaced by water.

The housing is somewhat translucent and colored with red and white tints in appropriate areas to represent the various parts of the Santa Claus figure. As viewed in FIG. 2, an electrically-energized light source 18 is mounted in the housing for illuminating the front translucent surface for decorative purposes. Light source 18 is connected to an electric power source 20 through a suitable electrical conductor 22. The rear of the housing has an opening 23.

Figure 2:
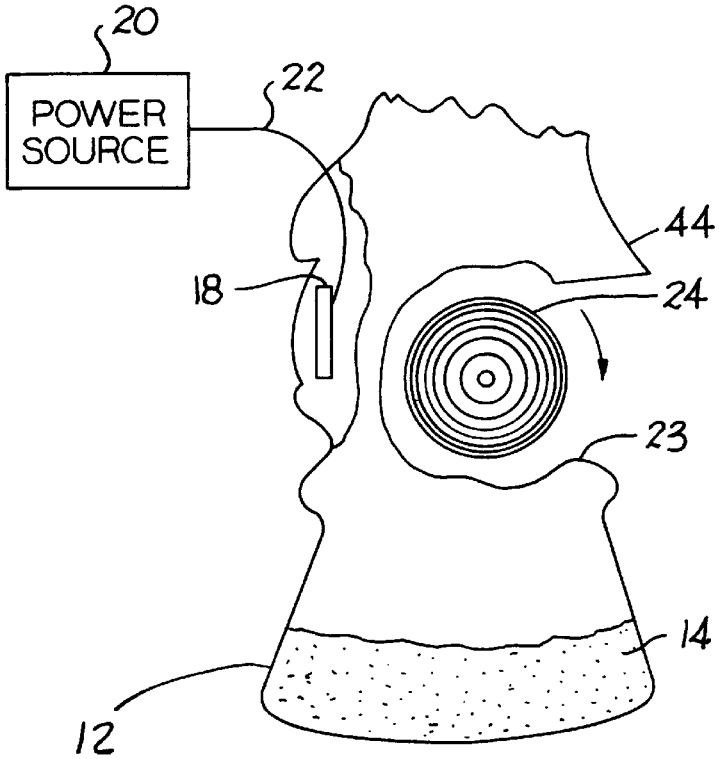
FIG. 2 is a view showing the housing in section.
Figure 3:
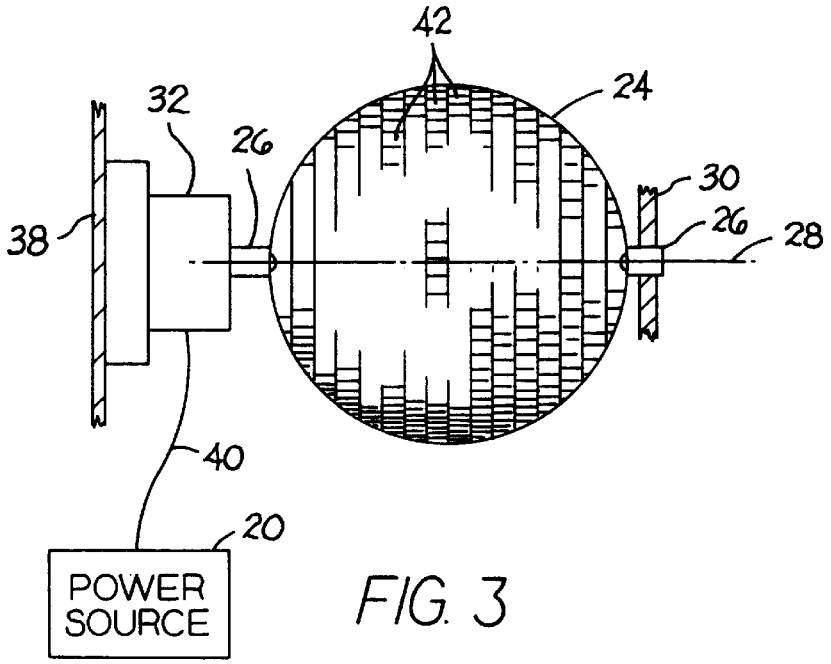
FIG. 3 is a fragmentary view of the housing to show the reflective body.

Referring to FIGS. 1 to 3, a reflective body 24 is mounted in the housing adjacent opening 23 on axle means 26 for rotation about a horizontal axis 28. One end of axle means 26 is mounted in a suitable opening 30 of the housing. A motor 32 is drivingly connected to the other end of the axle and mounted on the opposite side of housing at 38. Motor 32 is connected by electrical conductor 40 to power source 20 in order to rotate body 24 about horizontal axis 28.

Figure 5:
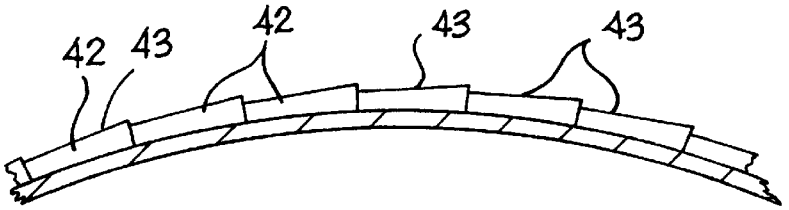
FIG. 5 is an enlarged sectional view showing a group of individual flat reflective surfaces.

Body 24 preferably has a diameter of about 7 inches and is covered with a plurality of identical, contiguous, flat mirror surface elements 42. The surface elements, for illustrative purposes, are each ½ inch square and each has an outer reflective surface 43, as illustrated in FIG. 5. Each surface 43 element has a flat reflective surface that is disposed in a plane that forms a slight angle with respect to the reflective surfaces adjacent reflective elements. The reflective elements are supported in an edge-to-edge configuration over substantially the entire surface of the rotating body.

The housing has an integral rain shield 44, as illustrated in FIG. 2, for protecting the rotating body from the elements.

Figure 4:
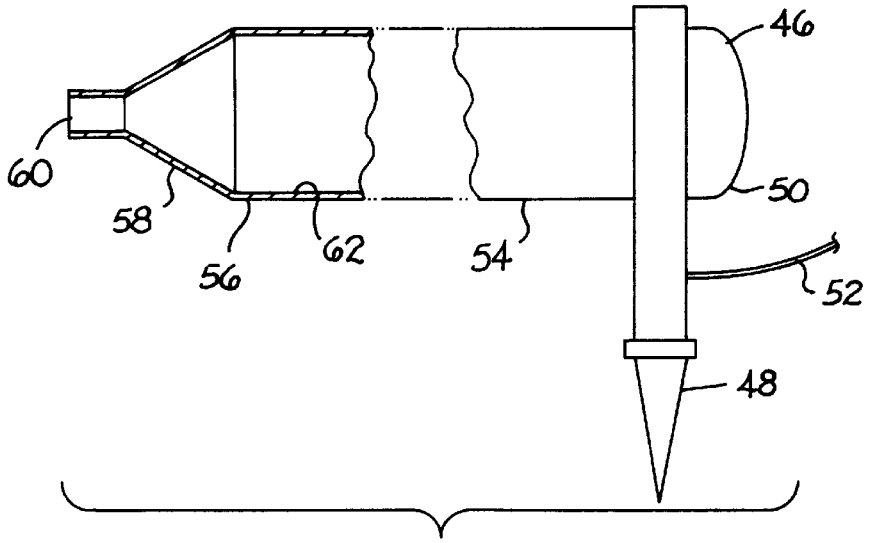
FIG. 4 is an enlarged view of a preferred light source.

A light source, generally indicated at 46 and illustrated in FIG. 4, comprises an electrically-energized low voltage 30 watt yard light. The lamp is mounted on a plastic stake 48 by a clamping means 50. Stake 48 is implanted in the ground at an adjusted distance with respect to the rotating body in order to produce light images of a desired size. The lamp is connected by electrical conductor 52 to the power source.

The lamp has a somewhat cylindrical housing 54. A mask 56 having a cylindrical end is slidably mounted on housing 54. The mask has a funnel-shaped section 58 terminating in a circular outlet opening 60 having a diameter of about ⅝ inches for reducing the size of the light rays transmitted by the lamp toward the reflective surfaces. The internal surface 62 of the mask, preferable is formed of an polished finish, in order to reflect the light rays from the lamp toward opening 60.

Both housing 10 and the light source are portable. The distance between them is adjusted in order to accommodate the distance the reflected light rays travel to a remote wall 63 on which the simulated snowflakes are to be produced.

As best shown in FIG. 1, light source 46 is mounted on ground 16 at an adjusted distance "A" from the revolving reflective body in order to project light rays onto several of the square reflective surfaces. Each reflective surface reflects a light image, for example, by light rays 64A, 64B and 64C, to form descending simulated snowflakes 66A, 66B and 66C on wall 62. Several simulated snowflake images are projected at any given time on the wall, each image descending as the reflective body is rotated in the clock-wise direction as viewed in FIGS. 1 and 2. Each light image is relatively small because of the mask opening as well as the flat surface of the individual light-reflecting elements.

For illustrative purposes, the rotary body is about 15 feet from the wall 63. The size of the snowflakes is determined, in part, by the distance the light is reflected from the rotating body.

Having described my invention, I claim:

1. A Portable light-reflective apparatus for simulating falling snow flakes (66A 66B, 66C) on a remote surface (63), comprising:

a housing (10) having a supporting base (12);

an axle (26) supported by the housing (10) parallel to the supporting base (12);

a rotating body (24) secured to the axle (26) for pivotal rotation about a single, horizontal axis (28);

said rotating body having an outer surface;

a plurality of light reflecting surfaces (43) carried on the outer surface of the rotating body (24) in a generally globular arrangement; and an exterior light source (46) mounted at a variable adjustable distance remote from the light-reflecting surfaces (43) for transmitting light rays toward the light reflecting surfaces (43) such that the light rays are reflected to form a plurality of slowly descending similar and spaced light images on a surface (63) remote from the light-reflecting surfaces (43).

2. The apparatus as defined in claim 1, in which the light-reflecting surfaces (43) on the rotating body (24) are mounted in a generally spherical arrangement.

3. The apparatus as defined in claim 1, in which the light-reflecting surfaces (43) on the rotating body (24) comprise a plurality of adjacent, similarly-shaped light-reflecting elements (42), each of said elements (42) having a flat reflective surface (43) disposed in a plane, the angle of the plane of each of said elements being at an angle from the planes of the adjacent light-reflecting elements (41).

4. The apparatus as defined in claim 1, in which the housing (10) is a decorative hollow housing (10) having an opening (30) for receiving light from the light source (46) and for reflecting the light rays (64A, 64B, 64C) from the light-reflecting surfaces (43) to the remote surface (63).

5. The apparatus as defined in claim 4, including a stabilizing means (14) mounted in the base (12) of the housing (10) for supporting the housing (10) in an upright position.

6. The apparatus as defined in claim 5, in which said stabilizing means (14) comprises sand.

7. The apparatus as defined in claim 5, in which said stabilizing means (14) comprises water.

8. The apparatus as defined in claim 1, in which the housing (10) is shaped in the form of a Christmas decoration.

9. The apparatus as defined in claim 8, in which the Christmas decoration is in the shape of a Santa Claus.

10. The apparatus as defined in claim 1, in which the light source (46) comprises a lamp having a pointed stake (48) for attaching the light source (46) to a ground surface.

11. The apparatus as defined in claim 1, in which the adjustable distance of the light source (46) from the light reflecting surfaces (43) on the rotating body (24) is adapted to adjust the size and location of the reflected images displayed on the remote surface (63).

12. The apparatus as defined in claim 1, in which the rotating body (24) can be slowly rotated so that the reflected images (43) slowly descend on the remote surface (63) to simulate falling snow (66A, 66B, 66C).

* * * * *